US006342860B1

(12) United States Patent
Haussler et al.

(10) Patent No.: US 6,342,860 B1
(45) Date of Patent: Jan. 29, 2002

(54) MICRO-INTERNAL ANTENNA

(75) Inventors: Bradley S. Haussler; Govind R. Kadambi; Kenneth D. Simmons; Jon L. Sullivan, all of Lincoln, NE (US)

(73) Assignee: Centurion Wireless Technologies, Lincoln, NE (US)

( * ) Notice: Subject to any disclaimer, the term of this patent is extended or adjusted under 35 U.S.C. 154(b) by 0 days.

(21) Appl. No.: 09/780,192

(22) Filed: Feb. 9, 2001

(51) Int. Cl.[7] ..... H01Q 1/24
(52) U.S. Cl. ..... 343/702; 343/872
(58) Field of Search ..... 343/702, 700 MS, 343/846, 873, 872, 841

(56) References Cited

U.S. PATENT DOCUMENTS 5,455,596 A * 10/1995 Higashiguchi et al. ..... 343/741
5,550,554 A * 8/1996 Erkocevic ..... 343/828
6,005,524 A * 12/1999 Hayes et al. ..... 343/702

* cited by examiner

*Primary Examiner*—Don Wong
*Assistant Examiner*—Hoang Nguyen
(74) *Attorney, Agent, or Firm*—Zarley, McKee, Thomte Voorhees & Sease; Dennis L. Thomte

(57) ABSTRACT

A Planar Inverted F Antenna (PIFA) is disclosed comprising a radiating element and a ground plane positioned on a bottom cover. A Radome is positioned over the radiating element and the ground plane with the bottom cover and the Radome enclosing the radiating element and the ground plane. The ground plane is positioned below the radiating element and a conductive shorting strip extends between one end of the radiating element and one end of the ground plane. A feed lead extends from one side of the radiating element and has a base portion which protrudes outwardly of the Radome for connection to the center conductor of a RF power feeding cable. The radiating element includes a first horizontally disposed portion, a second horizontally disposed portion, and a substantially vertically disposed portion extending therebetween. The first substantially vertically disposed portion of the radiating element functions as a first capacitive loading plate with the second horizontally disposed portion of the radiating element functioning as a second capacitive loading plate. A dielectric block is positioned between the second horizontally disposed portion of the radiating element for providing dielectric loading to the radiating element.

11 Claims, 8 Drawing Sheets

MICRO-INTERNAL ANTENNA

BACKGROUND OF THE INVENTION

1. Field of the Invention

The present invention relates to a Planar Inverted F Antenna (PIFA) and in particular to a method of designing a single band PIFA as an encapsulated module with a localized ground plane and multiple external lead contacts for easy integration to the chassis of a radio communication device.

2. Description of the Related Art

With the rapid progress in wireless communication technology and the ever-increasing emphasis for its expansion, wireless modems on laptop computers and other handheld radio devices will be a common feature. The technology using a short-range radio link to connect devices such as cellular handsets, laptop computers and other handheld devices has already been demonstrated [Wireless Design On-line Newsletter, Vol. 3, Issue 5, Nov. 22, 1999]. The ISM band (2.4–2.5 GHz) is the allocated frequency band for such applications. The performance of the antenna placed on devices like a cellular handset or a laptop computer is one of the critical parameters for the satisfactory operation of such a radio link. Therefore the performance characteristics of the antenna located on communication devices assumes significant importance in the evolving technology of wireless modems.

Recently, in the cellular communication industry, there has been an increasing emphasis on internal antennas instead of conventional external wire antennas. The concept of an internal antenna stems from the avoidance of a protruding external radiating element by the integration of the antenna into the device itself. Internal antennas have several advantageous features such as being less prone to external damage, a reduction in overall size of the handset with optimization, and easy portability. In most internal antenna designs, the printed circuit board of the communication device serves as the ground plane of the internal antenna. Among the various choices for internal antennas, a PIFA appears to have great promise. The PIFA is characterized by many distinguishing properties such as relative light weight, ease of adaptation and integration into the device chassis, moderate range of bandwidth, Omni-directional radiation patterns in orthogonal principal planes for vertical polarization, versatility for optimization, and multiple potential approaches for size reduction. The PIFA also finds useful applications in diversity schemes. Its sensitivity to both vertical and horizontal polarization is of immense practical importance in mobile cellular/RF data communication applications because of absence of the fixed antenna orientation as well as the multi-path propagation conditions. All these features render the PIFA to be a good choice as an internal antenna for mobile cellular/RF data communication applications.

A conventional prior art single band PIFA assembly 100 is illustrated in FIGS. 9 and 10. The PIFA 100 shown in FIG. 9 and 10 consists of a radiating element 101, a ground plane 102, a power feed hole 103 is located corresponding to the radiating element 101, a connector feed pin 104, and a conductive post or pin 105. The connector feed pin 104 serves as a feed path for radio frequency (RF) power to the radiating element 101. The connector feed pin 104 is inserted through the feed hole 103 from the bottom surface of the ground plane 102. The connector feed pin 104 is electrically insulated from the ground plane 102 where the pin passes through the hole in the ground plane 102. The connector feed pin 104 is electrically connected to the radiating element 101 at 106 with solder. The body of the feed connector 107 is electrically connected to the ground plane 102 at 108 with solder. The connector feed pin 104 is electrically insulated from the body of the feed connector 107. A through hole 109 is located corresponding to the radiating element 101, and a conductive post or pin 110 is inserted through the hole 109. The conductive post 110 serves as a short circuit between the radiating element 101 and the ground plane 102, The conductive post 110 is electrically connected to the radiating element 101 at 111 with solder. The conductive post 110 is also electrically connected to the ground plane 102 at 112 with solder. The resonant frequency of the PIFA 100 is determined by the length (L) and width (W) of the radiating element 101 and is slightly affected by the locations of the feed pin 104 and the conductive post or shorting pin 110. The impedance match of the PIFA 100 is achieved by adjusting the diameter of the connector feed pin 104, by adjusting the diameter of the conductive shorting post 110, and by adjusting the separation distance between the connector feed pin 104 and the conductive shorting post 110.

In the prior art techniques of PIFA design (Murch R. D. et al, U.S. Pat. No. 5,764,190; Korisch I. A., U.S. Pat. No. 5,926,139) the center conductor of the coaxial cable from the RF source is directly connected to the radiating element of the PIFA at the feed point. Further, in all these designs, the feed point of the PIFA is always drawn away from the shorted edge of the radiating element and is located within the central surface of the radiating element. Therefore, the feed cable from the RF source has to pass through the interior region (between the radiating element and the ground plane) of the PIFA. Such a prior art-feeding scheme of the PIFA will prove to be tedious and cumbersome in the final integration process. An alternative scheme of a PIFA design that circumvents such a tedious feed assembly is always desirable. From the structural and fabrication point of view, an avoidance of a feed cable extending through the interior region of the PIFA is preferred. This invention described hereinafter provides an encapsulated PIFA module in which the feed assembly is confined to the exterior of the module and hence overcomes the existing shortcomings in the final integration process of the prior art.

Keeping in pace with the rapid progress in mobile cellular communication technology, the future design of the cellular handset shall have the provision of more than one antenna to fulfill the additional requirement of BlueTooth (BT) applications. The placement of the additional internal antenna should be accomplished without necessitating any change in the overall size of the handset. The consideration of mutual coupling often warrants the placement of the cellular and BT antennas at different locations on the device chassis with a very small volume earmarked for the BT antenna. In cellular communication applications, multiple antennas may be required to utilize the phone chassis as a common ground plane. In such an application., the internal BT antenna will be an integral part of device chassis. Therefore such an additional internal antenna (for BT applications) such as a PIFA should have the desirable feature of simplified adaptability to the device chassis. A design of such an internal PIFA as a separate module with surface mountable features will be of great importance to facilitate a much simplified integration process.

SUMMARY OF THE INVENTION

A compact, lightweight, single band PIFA has been designed in an encapsulated modular form. The present invention emphasizes the feed assembly of the PIFA confined only to the exterior of the module. In the instant invention, one of the external leads of the encapsulated PIFA module facilitates the connection of the feed point of the PIFA to the RF source point of the radio device. The localized ground plane of the PIFA and the ground potential of the chassis of the radio device are connected by the other external leads.

DESCRIPTION OF THE PREFERRED EMBODIMENTS

Figure 1:
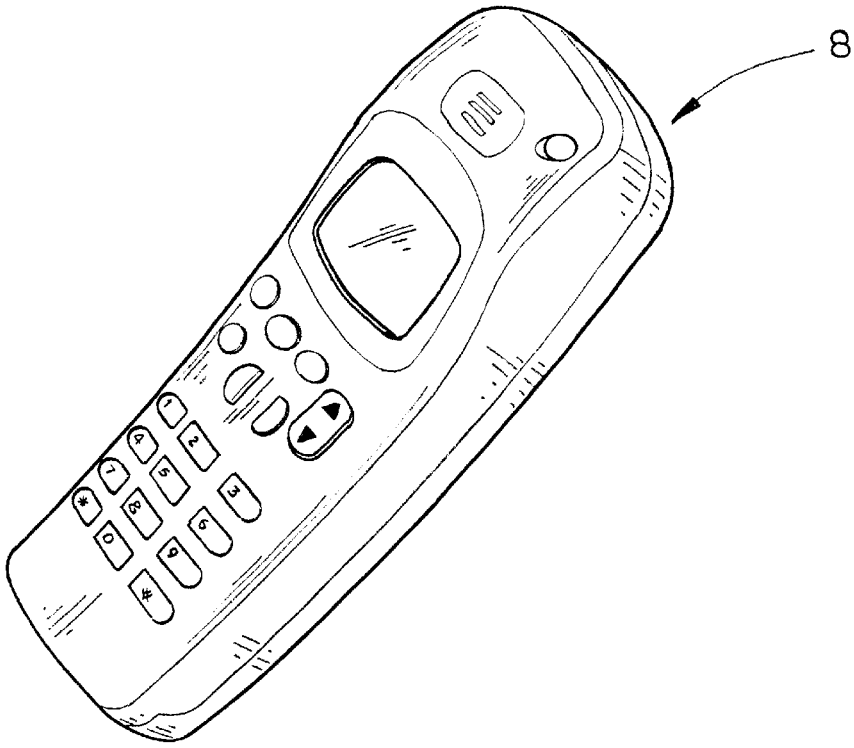
FIG. 1 is a perspective view of a cellular telephone handset having the micro-internal antenna of this invention mounted therein.
Figure 2:
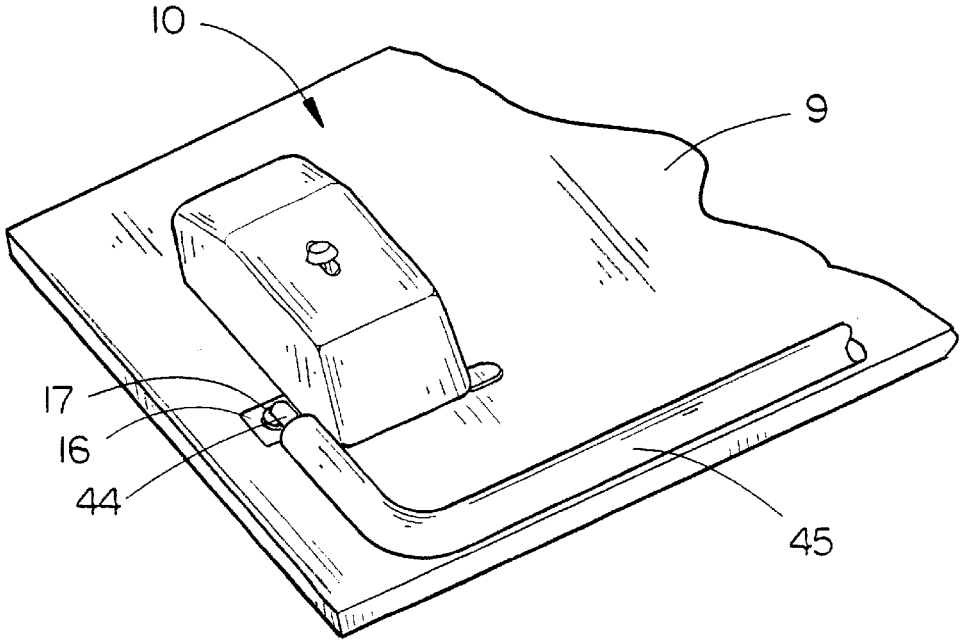
FIG. 2 is a perspective view of the antenna of this invention mounted on a chassis.
Figure 3:
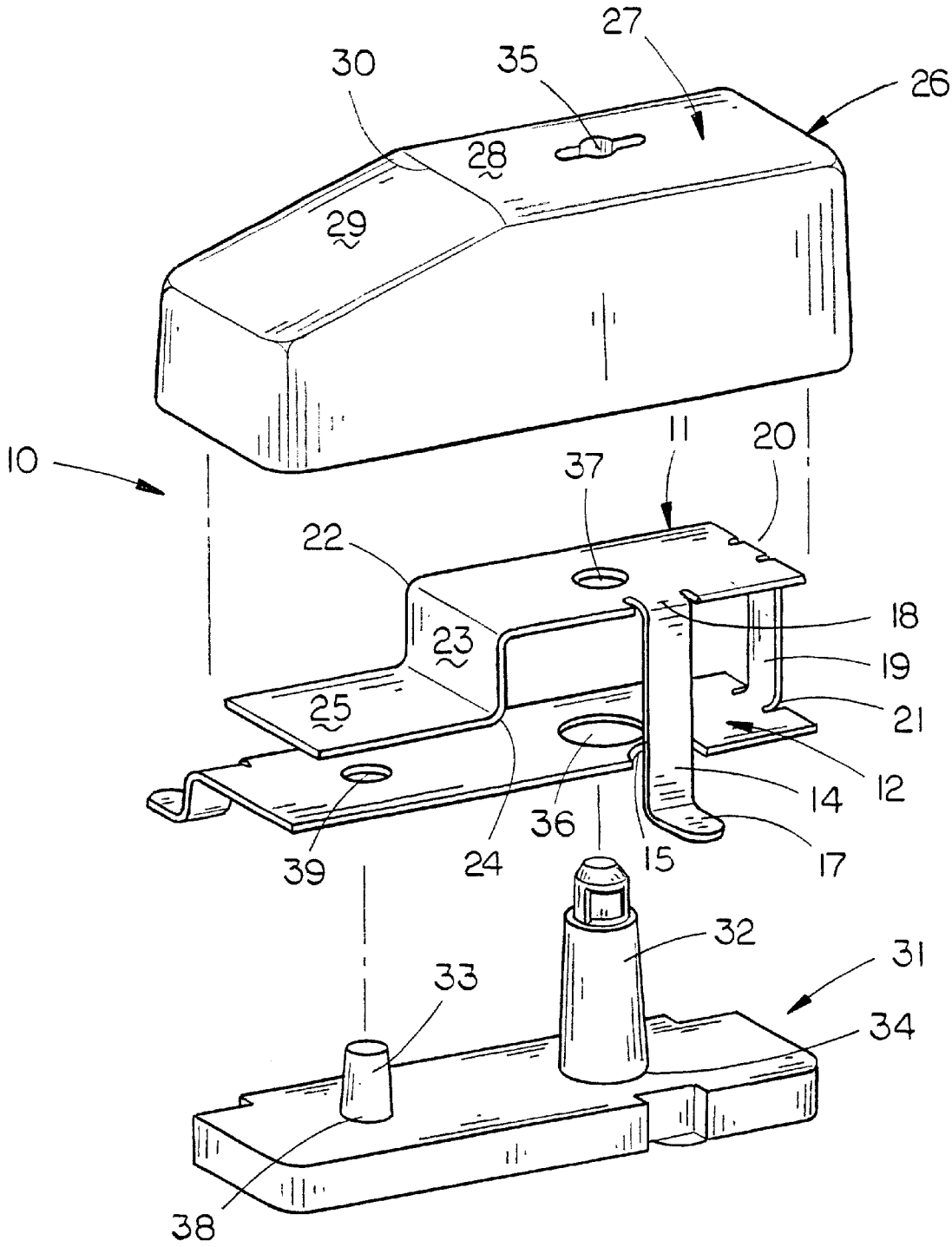
FIG. 3 is a partial exploded perspective view of the first embodiment of the antenna of this invention.
Figure 4:
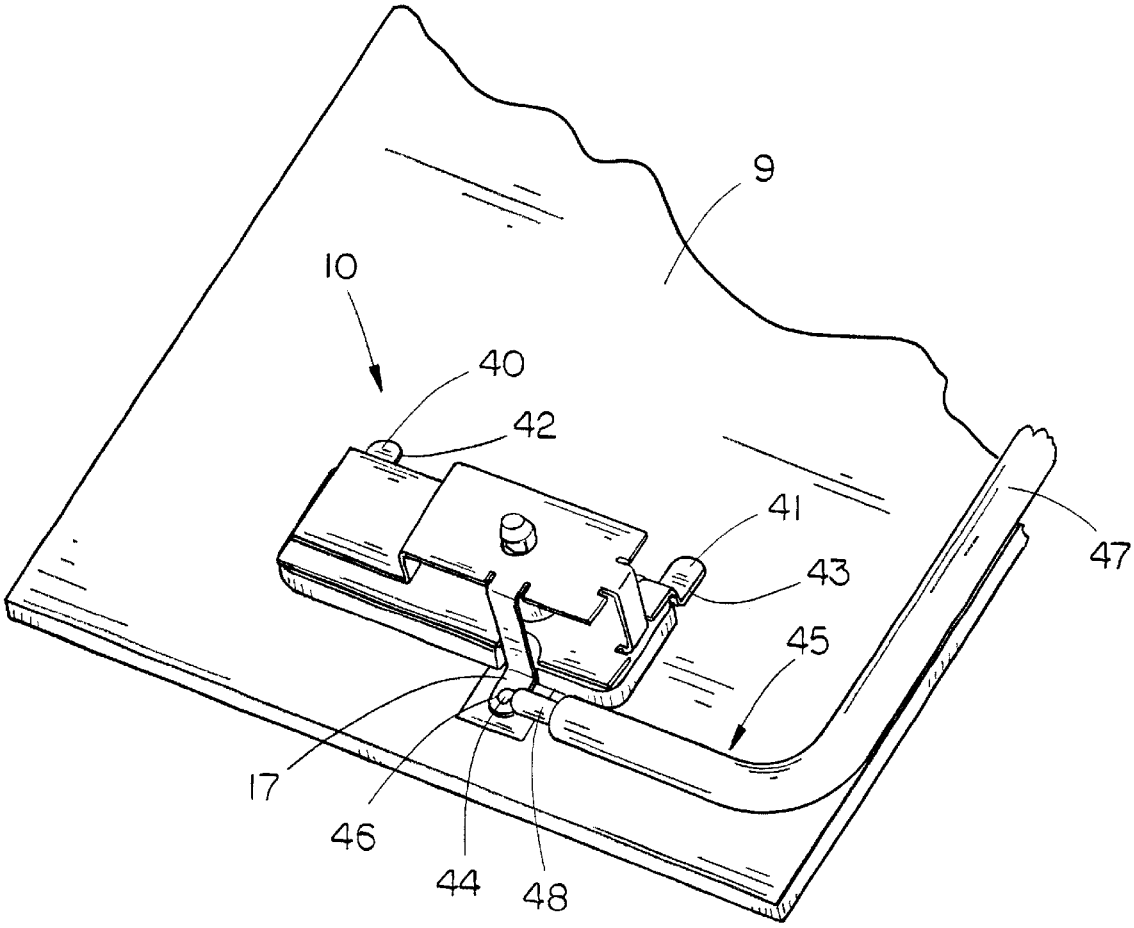
FIG. 4 is a partial perspective view of the antenna of FIG. 3 without the Radome.

In FIG. 1, the numeral 8 refers to a conventional cellular telephone handset including a chassis 9. In the accompanying text, the numeral 10 refers to the first embodiment of an encapsulated single band PIFA, as seen in FIGS. 2–4. The PIFA 10 includes a radiating element 11 that is located above a ground plane 12. An external metallic lead 14, which is a feed tab of the PIFA, serves as an electrical path for radio frequency (RF) power to the radiating element 11. The feed tab or lead 14 is electrically insulated from the local ground plane 12 by means of the notch 15 formed in the ground plane 12. The notch 15 formed in the ground plane 12 of the PIFA 10 is such that the feed tab 14 does not touch the ground plane 12. The feed tab 14 is also electrically insulated from the chassis 9 of the device by means of the notch 16 formed in the device chassis 9. The location and the size of the notch 16 on the device chassis 9 are such that the base 17 of the feed tab 14 does not touch the device chassis 9 (FIG. 2). The notch 16 on the device chassis 9 is realized by the removal of the metallization of the chassis over the area underlying the base 17 of the feed tab 14. The top end of the feed tab 14 is electrically connected to the radiating element 11 at 18. A conductive strip 19 serves as a short circuit between the radiating element 11 and ground plane 12. The conductive strip 19 is electrically connected to the radiating element 11 at 20 arid is electrically connected to the ground plane 12 at 21. The radiating element 11 is bent 90° at 22 to form a vertical plane 23. The vertical plane 23 is again bent 90° at 24 to form a lower horizontal plane 25. The horizontal plane 25 is at a specific distance above the ground plane 12. The horizontal plane 25 serves a capacitive loading plate for the radiating element 11. The Radome 26, which encapsulates the PIFA 10, includes two separate parts with identical dielectric material property. The top cover 27 of the Radome 26 fully encloses the radiating element 11 and the local ground plane 12 of the PIFA 10. The top cover 27 of the Radome 26 is designed to have a combination of a flat planar contour 28 and an inclined planar contour 29 resulting in a wedge shaped geometry along 30. The surface of the top cover 27 of the Radome 26 with flat planar contour 28 is flush with the unbent portion of the radiating element 11. The surface of the top cover 27 with an inclined planar contour 29 is designed so as to enclose the vertical section 23 and lower horizontal section 25 of the radiating element 11. The bottom cover 31 of the Radome 26 comprises a flat surface designed to be in flush with the lower surface of the ground plane 12 of the PIFA. The bottom cover 31 of the Radome 26, the ground plane 12 of the PIFA 10, the radiating element 11 of the PIFA and the top cover 27 of the Radome 26 are held together at specified height and locations through the two supporting dielectric blocks 32 and 33. The supporting dielectric block 32 connects the bottom cover 31 and the top cover 27 of the Radome 26 at 34 and 35, respectively, The supporting dielectric block 32, while connecting the bottom cover 31 and top cover 27, passes through a close fitting hole 36 on the ground plane 12 as well as a close fitting hole 37 on the radiating element 11. The supporting dielectric block 33 holds the lower horizontal section 25 of the radiating element 11 at a predetermined height from the ground plane 12. The supporting dielectric block 33 with base 38 on the bottom cover 31 passes through a close fit hole 39 on the ground plane 12 and extends vertically up to touch the lower horizontal section 25 of the radiating element 11.

The integration of the encapsulated module of the PIFA 10 to the device chassis 9 is carried out in two steps (FIG. 4). In the first step, the PIFA module is placed at the desired location on the device chassis 9 and the external metallic tabs 40 and 41 of the PIFA module are connected to the device chassis 9 at 42 and 43 by solder. In the second step, the center conductor 44 of the RF input cable 45 is connected to the base 17 of the external feed tab 14 at 46. The outer conductor 47 of the RF input cable 45 is soldered at numerous pre-selected locations on the device chassis 9 to prevent any radiation from the cable. The inner conductor 44 and the outer conductor 47 of the cable 45 are separated from the insulator 48 of the cable 45.

The PIFA 10 configuration illustrated in FIGS. 2–4 functions as an encapsulated single band PIFA. The dimensions of the radiating element 11, the vertical plane 23, the lower horizontal plane 25, the location of the shorting strip 19, the width of the shorting strip 19, the material property of the Radome 26 and the relative position of the PIFA 10 on the device chassis 9 are the prime parameters that control the resonant frequency of the PIFA. The bandwidth of the single band PIFA 10 is determined by width of the feed tab 14, the location of the feed tab 14, the location of the shorting strip 13, the width of the shorting strip 19, the material property of the Radome 26, and the linear dimensions of the radiating element 11 including the height of the PIFA. The measured resonant frequency is lower than the resonant frequency of the PIFA with only the radiating element 11 alone. The lowering of the resonant frequency of the PIFA 10 is due to the capacitive loading offered by the vertical plane 23 and lower horizontal plane 25. Further reduction of the resonant frequency is due to the dielectric loading caused by the encapsulation of the entire PIFA 10 within Radome 26.

Figure 5:
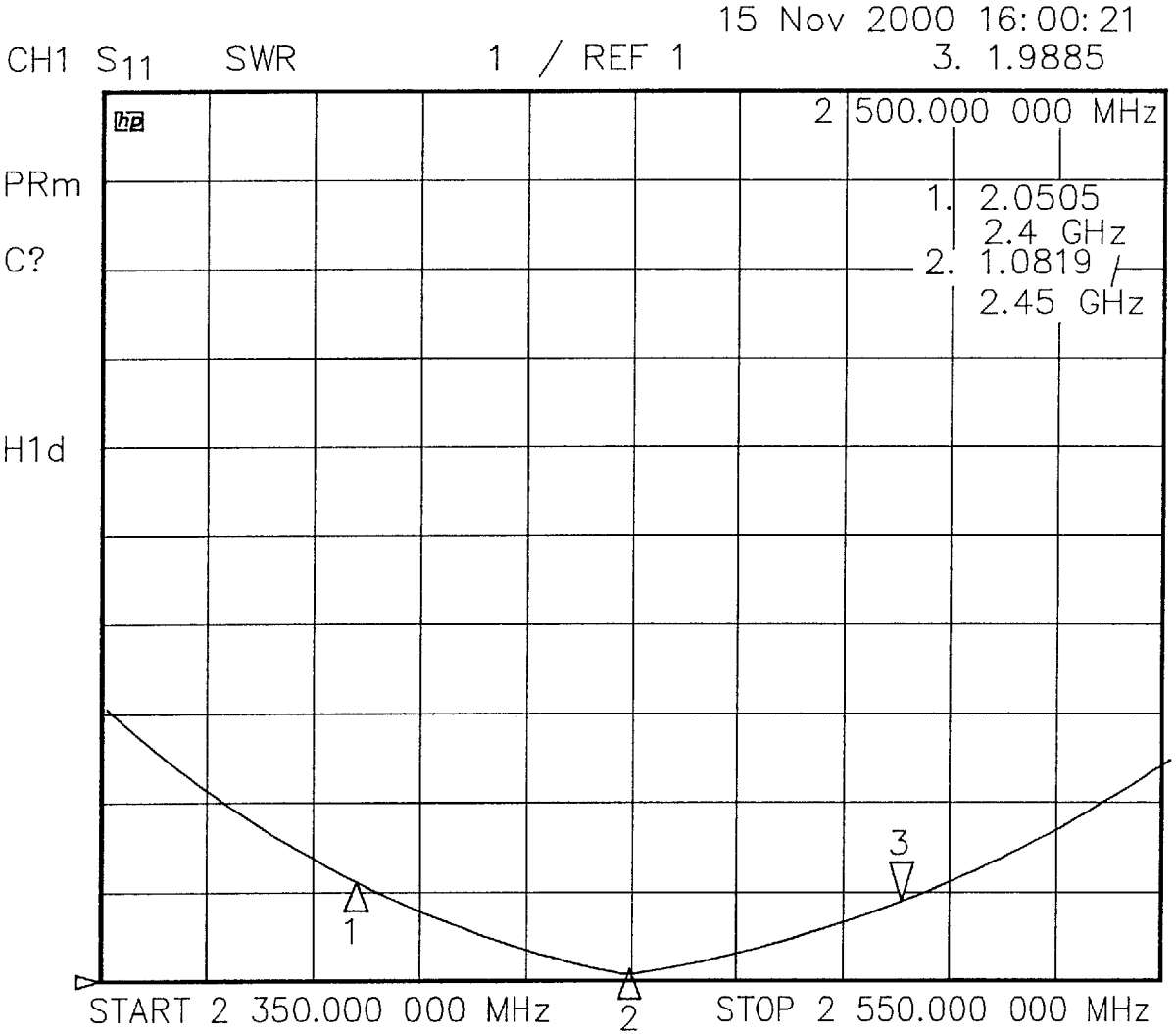
FIG. 5 is a frequency response chart that depicts the characteristics of the VSWR of the antenna of FIG. 4.

In its final configuration ready for the integration (FIGS. 2 and 4), the encapsulated PIFA 10 module will have three external leads protruding out of the Radome 17. The RF power input cable 45 is easily assembled to the PIFA module by connecting the center conductor 44 of the cable 45 to the protruding base 17 of the feed tab 14 through a solder connection (FIG. 2). The PIFA 10 module can easily be adapted to the device by connecting the external tabs 40 and 41 to the device chassis 9 at 42 and 43, respectively, by solder (FIG. 4). Thus, the proposed modular design of PIFA 10 of this invention greatly simplifies the task of integration of the PIFA to the device. Further, it can easily be inferred that the design of the PIFA 10 module has the distinct advantage of feed assembly which is confined only to the exterior dimensions of the module. The suggested modular design of this invention circumvents the hitherto imposed shortcoming of the feed assembly (cable) passing through the interior region of the PIFA. The result of the tests conducted on the single band PIFA 10, illustrated in FIGS. 2–4, referred to as the first embodiment of this invention, is shown in FIG. 5. FIG. 5 illustrates the VSWR plot of the single band PIFA 10 resonating in the ISM band (2400–2500 MHz). The dimensions of the single band PIFA 10 are: Length=16 mm, Width=5.5 mm and Maximum Height=4.5 mm. The projected semi-perimeter of the single band PIFA 10 is 21.5 mm as compared to the semi-perimeter of 30.61 mm of a conventional single band PIFA 110 resonating in the ISM band.

Figure 6:
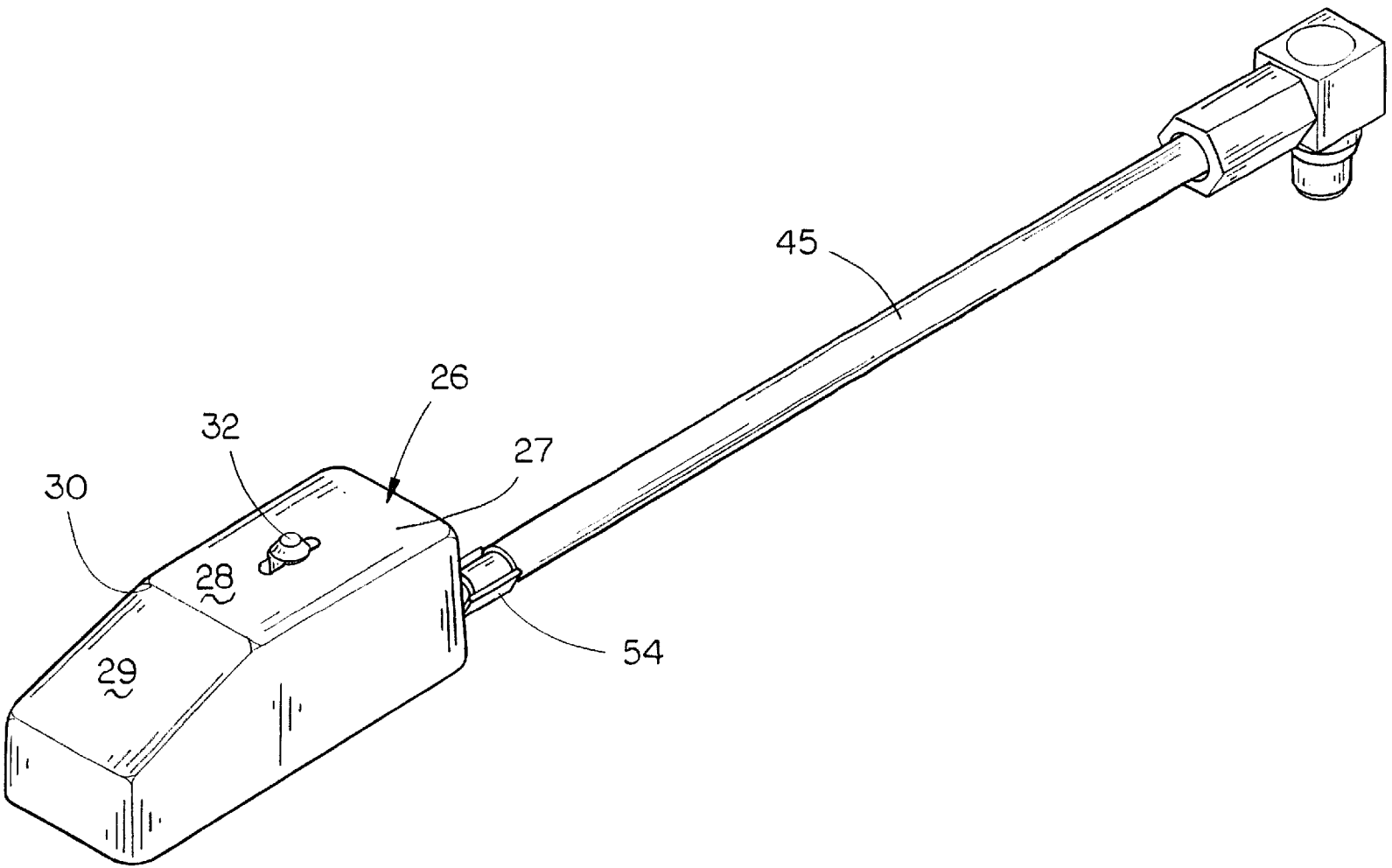
FIG. 6 is a perspective view of a second embodiment of the invention.
Figure 7:
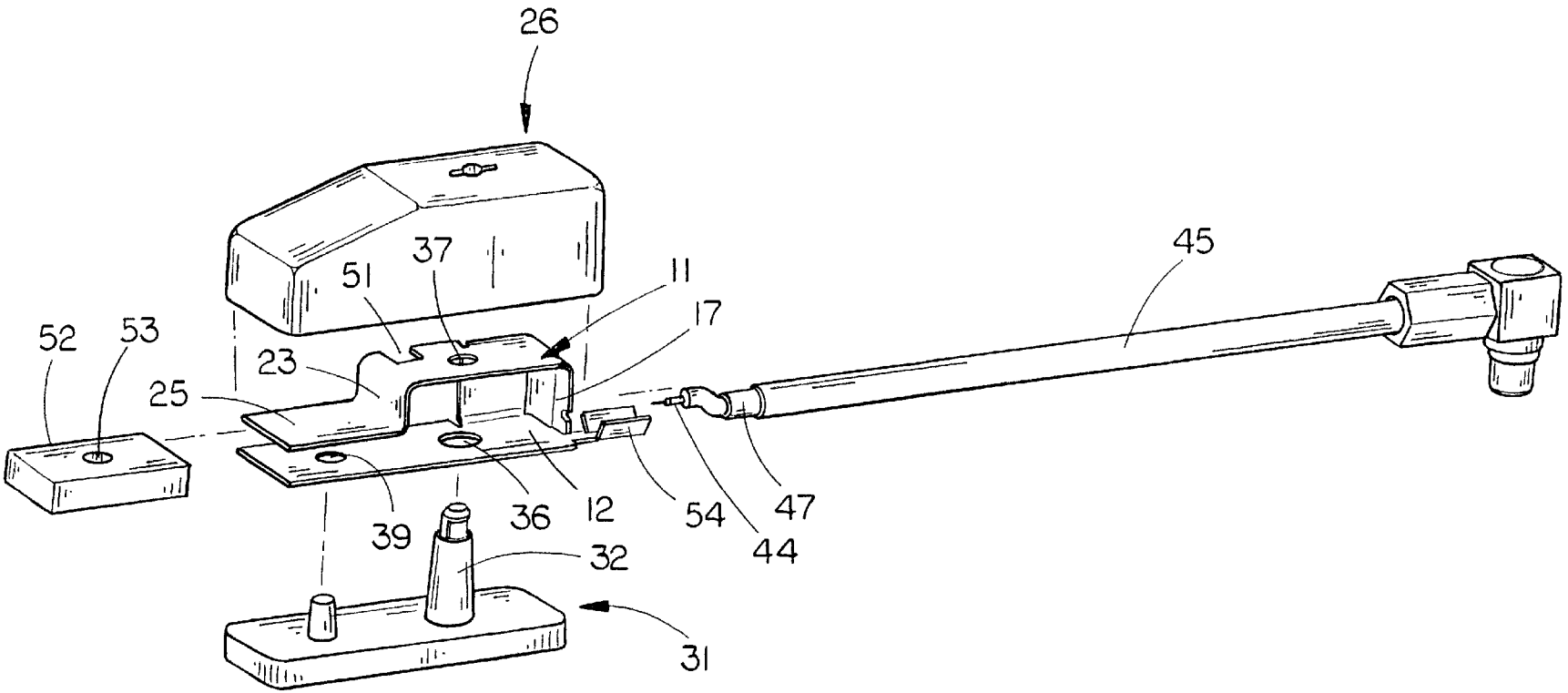
FIG. 7 is an exploded perspective view of the antenna of FIG. 6.

The second embodiment of the invention is illustrated in FIGS. 6 and 7. The single band PIFA 50 illustrated in FIGS. 6 and 7 is similar to the PIFA 10, but has an additional slot 51 formed in the radiating element 11 (FIG. 7). Further, there is a dielectric block 52 of pre-desired dielectric constant placed between the lower horizontal section 25 and the ground plane 12. The supporting block 33 passes through a tight fit hole 53 on the dielectric block 52 in addition to passing through the tight fit hole 39 on the ground plane 12. Also, the external leads 40 and 41 of PIFA 50, for connecting the ground plane 12 of the PIFA 10 to the device chassis 9, are absent. Therefore, the ground plane 12 of the PIFA 50 module is not connected to the ground potential of the device chassis 9 resulting in the physical isolation of the PIFA 50 from the device chassis 9. As a consequence, the effective size of the ground plane for the optimum performance of the PIFA 50 is merely the size of the localized ground plane 12 itself. This is in contrast to the relatively large effective ground plane for the PIFA 10 of the first embodiment of this invention where the localized ground plane 12 of the PIFA 110 is directly connected to the device chassis 9. Therefore, the significant feature of the design of PIFA 50 is the extremely small size of the ground plane 12. In actuality, the size of the ground plane 12 is comparable to the linear dimensions of the radiating element 11 of the PIFA 50. The size of the ground plane 12 has significant effect on the resonance characteristics and the gain performance of the PIFA. To achieve the resonance in the ISM band despite the miniaturization both in size of the PIFA 50 and the size of the ground plane 12, the dielectric loading of the PIFA 20 has also been incorporated through the dielectric block 52. Provision has been made for connecting the outer conductor 47 of the RF input cable 45 to the external tab 54 to offer a ground potential to the PIFA 50. The external tab 54 is a protrusion of the ground plane 12 of the PIFA 50. All the other elements of the single band PIFA 50 illustrated in FIGS. 6 and 7 are identical to the single band PIFA 10 illustrated in FIGS. 2–4 which has already been explained while covering the first embodiment of this invention. Further redundant explanation of the single band PIFA 50 illustrated in FIGS. 6 and 7 will therefore be omitted.

Figure 8:
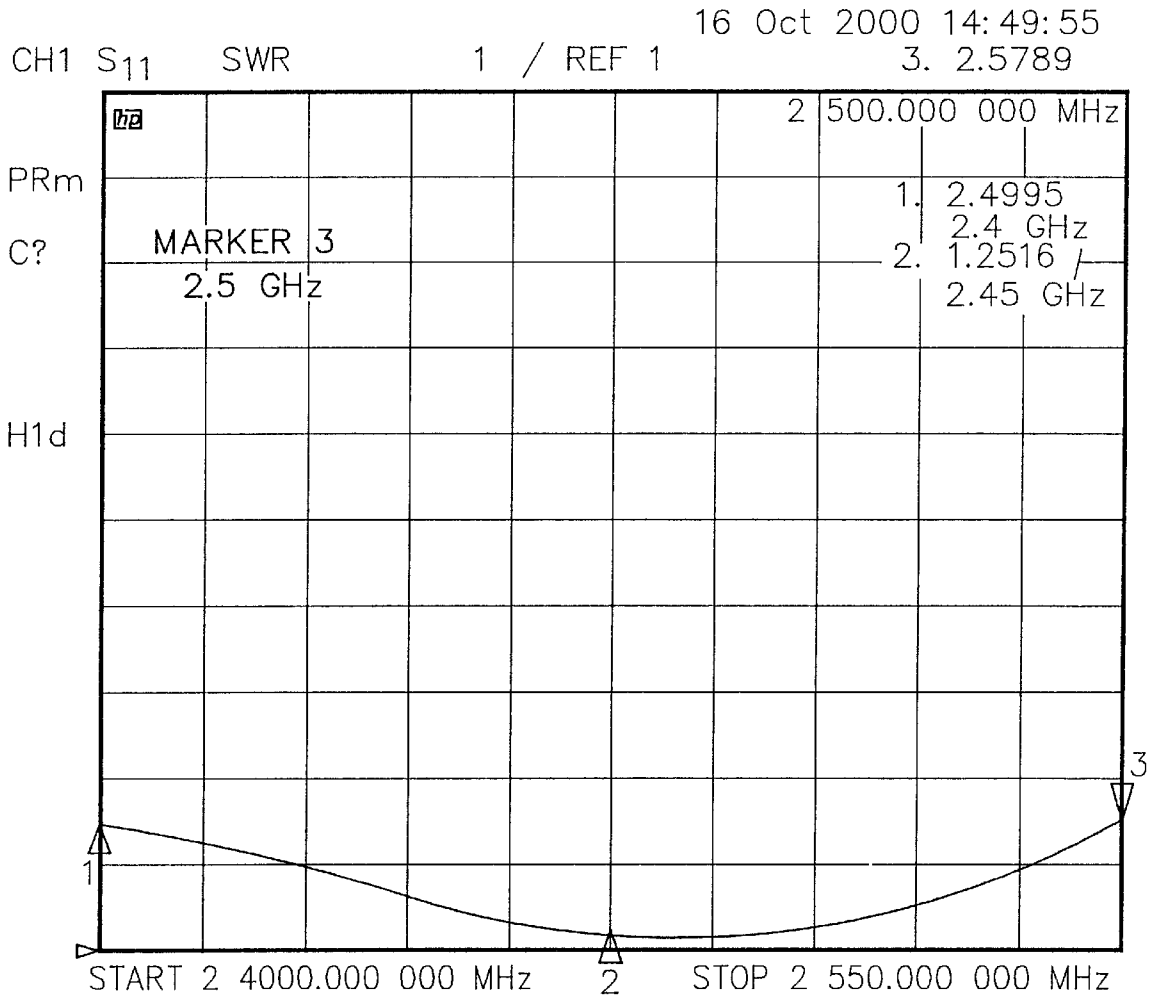
FIG. 8 is a frequency response chart that depicts the characteristics of the VSWR of the antenna of FIG. 6.
Figure 9:
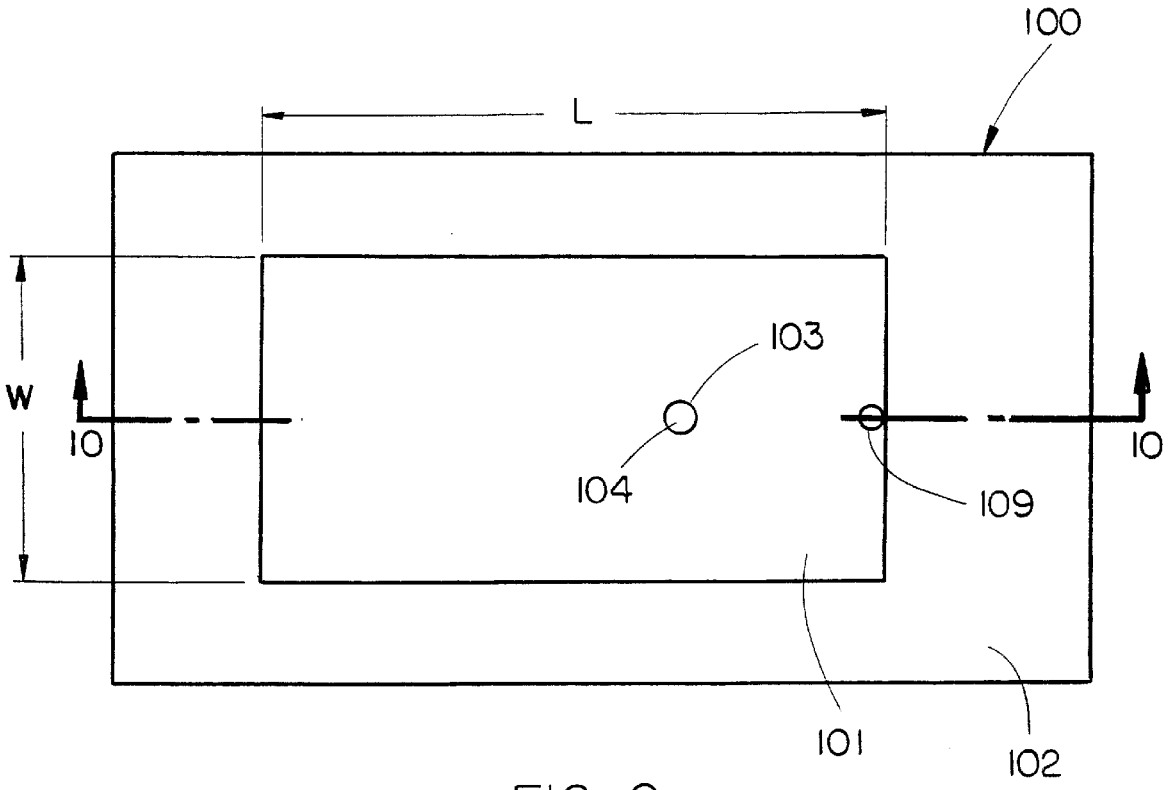
FIG. 9 (PRIOR ART)
FIG. 9 is a top view of a prior art antenna.
Figure 10:
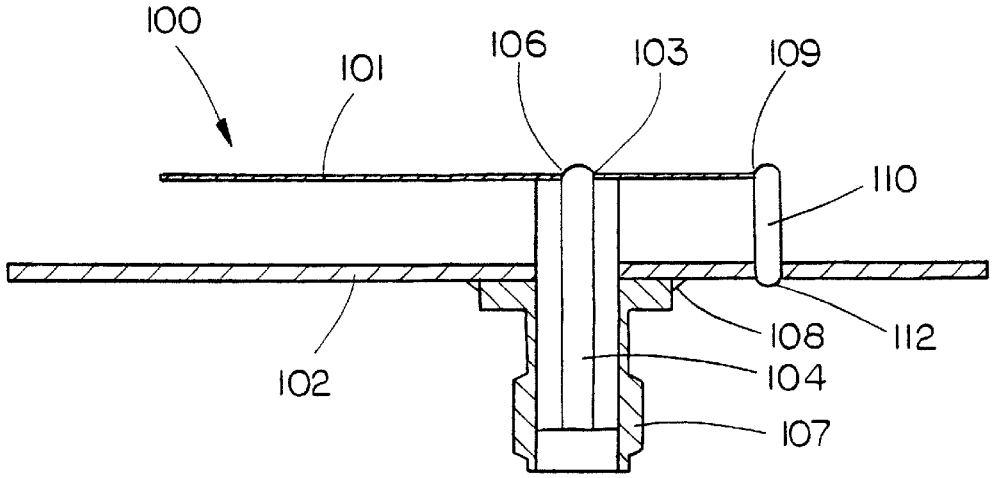
FIG. 10 (PRIOR ART)
FIG. 10 is a partial sectional view as seen on lines 10—10 of FIG. 9.

The slot 51 is positioned between the vertical plane 23 and the shorting strip 19 and is located corresponding to a position on the radiating element 11 of the PIFA 50 as illustrated in FIG. 7. The choice of the location of the slot 51 illustrated in FIG. 7 has been with a specific purpose to offer reactive loading effect to the radiating element 11. Hence the size and position of the slot 51 will control the resonant frequency of the PIFA 50. In its final configuration ready for the integration (FIGS. 6 and 7), the encapsulated PIFA 50 module will have two external leads protruding out of the Radome 26. The RF power input cable 45 is easily assembled to the PIFA module by connecting the center conductor 44 of the cable 45 to the protruding base 17 of the feed tab 14 through a solder connection (FIG. 7). The shield (outer conductor) 47 of the cable 45 is soldered to the protruding external tab 54. From this, it can easily be inferred that the design of the PIFA 50 module has the distinct advantage of feed assembly, which is confined only to the exterior dimensions of the module. The suggested modular design of this invention circumvents the hitherto imposed shortcoming of the feed assembly (feed cable) passing through the interior region of the PIFA. The result of the tests conducted on the single band PIFA 50 illustrated in FIGS. 6 and 7 referred to as the second embodiment of this invention is shown in FIG. 8. FIG. 8 illustrates the VSWR plot of the single feed multi-band PIFA 50 resonating in the ISM band (2400–2500 MHz). The dimensions of the single band PIFA 50 are: Length=16 mm, Width=5.5 mm and Maximum Height=4.5 mm. The projected semi-perimeter of the multi-band PIFA 50 is 21.5 mm as compared to the semi-perimeter of 30.61 mm of a conventional single band PIFA 110 resonating in the ISM band only.

As can be seen from the foregoing discussions, a novel scheme to design a single band PIFA in a modular form has been proposed and demonstrated. The suggested design of the PIFA in a modular form has the distinct advantage and the desirable feature of easy and much simplified integration to the device chassis. In the PIFA designs of this invention, the feed assembly is confined only to the exterior of the module resulting in enhanced fabrication ease. The proposed design also overcomes the tedious feed assembly of the prior art techniques of the PIFA design. The radiating element, the shorting strip, the feed tab, and the ground plane of the PIFA are so configured to facilitate the formation of the PIFA in one process of continues and sequential bending of a single sheet of metal resulting in improved manufacturability. The resonance of the PIFA in ISM band has been achieved without increasing the effective area of antenna, thereby accomplishing the miniaturization of the size of the PIFA. The concept of the slot loading technique and the partial dielectric loading has also been invoked in this invention to achieve the reduction of resonant frequency of the PIFA without increasing the size of the PIFA. The concept of partial dielectric loading involving the dielectric block over a small and selective area of the PIFA reduces the weight and cost of the PIFA. The partial dielectric loading also results in a relative reduction of the dielectric loss and hence contributes to the enhanced radiation efficiency of the PIFA. The encapsulated single band PIFA 10 and PIFA 50 as of this invention are lightweight, compact, cost-effective and easy to manufacture.

Thus the novel design technique of encapsulated single band PIFA in a modular form of this invention has accomplished at least all of its stated objectives.

We claim:

1. A Planar Inverted F Antenna (PIFA), comprising:

a bottom cover;

a radiating element having first and second ends, first and second sides, and upper and lower ends;

a ground plane positioned below said radiating element having first and second ends, first and second sides, and upper and lower ends;

said radiating element and said ground plane being positioned on said bottom cover;

a conductive shorting strip extending between said first end of said radiating element and said first end of said ground plane;

a feed lead extending from said first side of said radiating element;

and a Radome positioned over said radiating element and said ground plane;

said bottom cover and said Radome enclosing said radiating element and said ground plane;

said feed lead having a base portion protruding outwardly of said Radome for connection to the center conductor of a RF power feeding cable.

2. The PIFA of claim 1 wherein said radiating element includes a first horizontally disposed portion, a second horizontally disposed portion, and a substantially vertically disposed portion extending therebetween.

3. The PIFA of claim 2 wherein said first substantially vertically disposed portion functions as a first capacitive loading plate of said radiating element.

4. The PIFA of claim 3 wherein said second horizontally disposed portion functions as a second capacitive loading plate of said radiating element.

5. The PIFA of claim 4 wherein said first horizontally disposed portion has a reactive loading slot formed therein.

6. The PIFA of claim 5 wherein said reactive loading slot is formed in said first horizontally disposed portion between said vertically disposed portion and said shorting strip.

7. The PIFA of claim 6 wherein a dielectric block is positioned between said second horizontally disposed portion of said radiating element at said ground plane for providing dielectric loading to said radiating element.

8. The PIFA of claim 7 wherein said radiating element, said shorting strip, and said ground plane are of one-piece construction.

9. The PIFA of claim 1 wherein said radiating element, said shorting strip, and said ground plane are of one-piece construction.

10. The PIFA of claim 1 wherein a pair of tabs extend from said ground plane outwardly of said Radome for connection said ground plane to the chassis of the device in which said PIFA is being used.

11. The PIFA of claim 1 wherein a tab extends from said ground plane outwardly from said Radome for connection to a RF cable.

* * * * *